US005348594A

United States Patent [19]

Hanamura et al.

[11] Patent Number: 5,348,594

[45] Date of Patent: Sep. 20, 1994

[54] TI-AL INTERMETALLIC COMPOUND WITH SE

[75] Inventors: Toshihiro Hanamura; Ryuji Uemori; Mitsuru Tanino; Jin-ichi Takamura, all of Kawasaki, Japan

[73] Assignee: Nippon Steel Corporation, Tokyo, Japan

[21] Appl. No.: 58,840

[22] Filed: May 6, 1993

Related U.S. Application Data

[63] Continuation of Ser. No. 758,379, Sep. 3, 1991, abandoned, which is a continuation of Ser. No. 349,255, May 9, 1989, abandoned.

[30] Foreign Application Priority Data

May 13, 1988 [JP] Japan ..... 63-116244
Dec. 16, 1988 [JP] Japan ..... 63-317687

[51] Int. Cl.[5] ..... C22C 14/00

[52] U.S. Cl. ..... 148/421; 148/407; 420/418; 420/421

[58] Field of Search ..... 148/421, 407; 420/418, 420/419, 420, 421

[56] References Cited

U.S. PATENT DOCUMENTS 3,203,794 8/1965 Jaffee et al. ..... 420/418
4,294,615 10/1981 Blackburn et al. ..... 420/420
4,810,465 3/1989 Kimura et al. ..... 420/420

FOREIGN PATENT DOCUMENTS 525343 5/1956 Canada ..... 420/418
62884 6/1961 Canada ..... 420/418
2462483 2/1981 France .
58-123847A 7/1983 Japan .
59-00581B 1/1984 Japan .
61-41740A 2/1986 Japan .

OTHER PUBLICATIONS

*Binary Alloy Phase Diagram* ed. T. Massalski; 1986 pp. 173, 175.

Metallurgical Transactions, vol. 6A, 1975, pp. 1991–1996.

Symposium of Japanese Association of Metals, Plastic Deformation of Ordered Alloys and Intermetallic Compounds, pp. 13–16, Jul. 16, 1988.

*Primary Examiner*—Melvyn J. Andrews
*Assistant Examiner*—Margery S. Phipps
*Attorney, Agent, or Firm*—Kenyon & Kenyon

[57] ABSTRACT

A Ti—Al intermetallic compound has a compressibility of at least 25% at room temperature and a superior high temperature oxidation resistance and consists essentially of about 40 to 52 atomic percent of Ti, about 48 to 60 atomic percent of Al, and 10 to 1000 atomic ppm of at least one of P, As, Se, or Te.

5 Claims, 2 Drawing Sheets

TI-AL INTERMETALLIC COMPOUND WITH SE

This application is a continuation of application Ser. No. 07/758,379 filed on Sep. 3, 1991, now abandoned, which is a continuation of Ser. No. 07/349,255 filed on May 9, 1989, now abandoned.

BACKGROUND OF THE INVENTION

1. Field of the Invention

The present invention relates to a Ti—Al intermetallic compound having an improved room-temperature ductility and high-temperature oxidation resistance, and suitable for use as a high-temperature heat-resistant strength material for aircraft turbine engines, gas turbines for power generators, automobile engines, rotation bodies and the like, and further, to a process for the preparation of this intermetallic compound.

2. Description of the Related Art

The Ti—Al intermetallic compound has almost the highest high-temperature specific strength among metallic materials, and furthermore, has an excellent corrosion resistance and a light weight. Note, it was reported in Metallurgical Transaction, Vol. 6A (1975), page 1991, that a high-temperature strength of 40 kg/mm$^2$ was obtained at 800° C., and therefore, it is considered that the Ti—Al intermetallic compound is most suitable for application to parts of gas turbines, valves and pistons of automobile engines, high-temperature dies, bearing parts and the like, due to the foregoing excellent characteristics.

The Ti—Al intermetallic compound has a composition latitude in the phase diagram, and in the composition range of 40 to 52 atomic % of Ti and 60 to 48 atomic % of Al, an Llo structure (basically a face-centered tetragonal structure but wherein the Ti layers and Al layers are arranged alternately in the [001] direction) is formed in the thermally equilibriated state. Accordingly, an abnormal strengthening phenomenon wherein the strength is increased in the single crystal state with an increase of the temperature was found, and it is known that, even in the case of polycrystalline materials, the strength is not reduced at a high temperature of up to 800° C. Nevertheless, the polycrystal of the Ti—Al intermetallic compound is defective in that the ductility is low at temperatures ranging from room temperature to about 700° C. For example, in the case of a composition of 48 atomic % of Ti and 52 atomic % of Al, the compressibility is 0.4% at room temperature and about 1.1% at 700° C. (see Japanese Examined Patent Publication No. 59-581).

The difficulties encountered in the development of a Ti—Al intermetallic compound as a practical material are mainly concerned with how to maintain a good room-temperature ductility, and it has been confirmed that an addition of Mn is effective for this purpose (see Japanese Unexamined Patent Publication No. 61-41740). It has been reported, however, that the addition of Mn leads to a lowering of the high-temperature oxidation resistance (Tsurumi et al., Symposium of Japanese Association of Metals, Plastic Deformation of Ordered Alloys and Intermetallic Compounds, page 13, Jul. 16, 1988).

Further, since the Ti—Al intermetallic compound has a light weight, a high heat-resistance, and an excellent corrosion resistance, it is suitable for a turbine blade to be used at high temperatures. However since the room-temperature ductility of the Ti—Al intermetallic compound is low (the compressibility is 0.4%), a casting or forging thereof is difficult and the safety reliability at room temperature is poor, and thus a practical utilization thereof is uncertain. Moreover, as a practical material for designing, a room-temperature ductility is necessary.

SUMMARY OF THE INVENTION

Therefore, a primary object of the present invention is to provide a Ti—Al intermetallic compound material having a room-temperature compressibility of at least 25% and an improved high-temperature oxidation resistance.

More specifically, in accordance with the present invention, there is provided a Ti—Al intermetallic compound comprising 40 to 52 atomic % of Ti and 48 to 60 atomic % of Al, and further, containing 10 to 3000 atomic ppm of at least one element selected from the group consisting of P, As and Sb (elements of the group V) and Se and Te (elements of the group VI), wherein the basic crystal structure of the matrix is an ordered structure of the Llo type, the room-temperature compressibility (ductility) is high, and a good high-temperature oxidation resistance is retained.

Furthermore, in accordance with the present invention, there is provided a process for the preparation of a Ti—Al intermetallic compound material, which comprises melting and solidifying a starting material having the above-mentioned composition in an inert gas atmosphere and, if necessary, annealing the solidified product.

DESCRIPTION OF THE PREFERRED EMBODIMENTS

Figure 1:
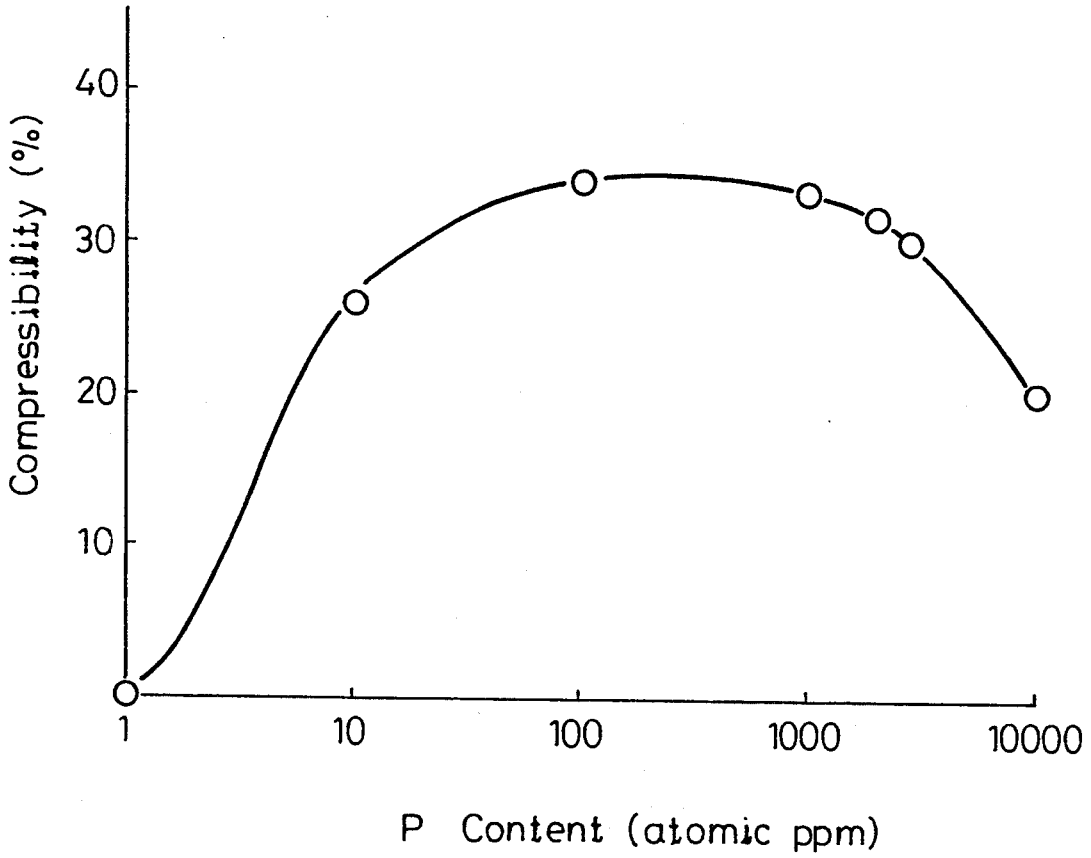
FIG. 1 illustrates the relationship between the amount added of phosphorus (P) and the compressibility in the Ti—Al intermetallic compound; and, FIG. 2 shows a stress-strain curve illustrating the results of the room temperature compression test of the materials of the present invention.

The present inventors carried out investigations into improving the ductility in the Ti—Al intermetallic compound, and as a result, found that, in the Ti—Al intermetallic compound in which at least one element selected from the group consisting of P, As and Sb (elements of the group V) and Se and Te (elements of the group VI) is incorporated, the compressibility is at least 25% at room temperature and about 60% at 600° C., and the ductility at temperatures ranging from room temperature to about 700° C. is greatly improved. Since in the tertiary element-free Ti—Al intermetallic compound (comprising 48 atomic % of Ti and 52 atomic % of Al), the compressibility is 0.4% and 1.1% at 700° C. (see Japanese Unexamined Patent Publication No. 62-215), it is considered that this remarkable performance is due to the incorporation of the above-mentioned tertiary component. Furthermore, it was found that the high-temperature oxidation resistance is greatly improved when compared to that of the tertiary element-free Ti—Al intermetallic compound and the Mn-added Ti—Al intermetallic compound.

The present invention will now be described in detail. In the present invention, the Ti content is adjusted to 40 to 52 atomic % to obtain a single phase of the Ti—Al intermetallic compound or a composition comprising a matrix of the Ti—Al intermetallic compound and a minor amount of a second phase of $Ti_3Al$. If the Ti content is outside the above-mentioned range, an incorporation of another second phase occurs and good results cannot be attained. More specifically, if the Ti content is lower than 40 atomic %, $Al_2Ti$ or $Al_3Ti$ is present as the second phase and the presence of these compounds is not preferable, since they are brittle. If the Ti content exceeds 52 atomic %, the amount of $Ti_3Al$ as the second phase is increased. The high-temperature strength of $Ti_3Al$ is lower than that of TiAl, and therefore, from the viewpoint of the high-temperature strength, a large proportion of $Ti_3Al$ is not preferable.

Namely, if the Ti content is from 40 to 50 atomic %, a single phase (Llo type ordered structure) of the Ti—Al intermetallic compound is obtained, and if the Ti content is higher than 50 atomic % and up to 52 atomic %, $Ti_3Al$ ($DO_{19}$ type ordered structure) is partially included as the second phase in the above-mentioned single phase. In the compound having this microstructure, the room-temperature ductility is improved when compared to that of the compound composed solely of the single phase, under some heating conditions. Note, if the Ti content is 40 to 45 atomic %, an incorporation of $Al_2Ti$ as the second phase becomes possible under some casting or forging conditions, and the improvement of the ductility is reduced. Therefore, in the present invention, in view of the microstructure, preferably the lower limit of the Ti content is 45 atomic %.

In the present invention, an element of the group v (P, As or Sb) and/or an element of the group VI (Se or Te) is incorporated in an amount of 10 to 3000 atomic ppm.

If the element of the group V (P, As or Sb) and/or the compound of the group VI (Se or Te) is present in the Ti—Al intermetallic compound, the stacking fault energy is reduced and twinning easily occurs during plastic deformation, with the result that the room-temperature ductility is improved. This effect is enhanced with an increase of the content of the additive element, as shown in FIG. 1.

Nevertheless, if the content of the additive element exceeds 3000 atomic ppm, the element of the group V (P, As or Sb) or the element of the group VI (Se or Te) is bonded to Ti to form a compound such as TiP, TiAs, TiSb, TiSe, $TiSe_2$ or $TiTe_2$ in the grain boundary and the matrix, this compound acts as the initiation point of a fracture, with the result that not only the room-temperature ductility but also the workability is lowered. If the content of the additive element is lower than 10 atomic ppm, the above-mentioned object cannot be obtained.

If the Ti—Al intermetallic compound is oxidized at high temperatures in an oxidizing atmosphere, $TiO_2$ is generally formed in the outermost layer. Since $TiO_2$ has an oxygen-depleted structure in which some of the lattice positions to be inherently occupied by O atoms are vacant in the crystal lattice, external oxygen atoms are diffused in the interior of the material through such oxygen-vacant positions and the oxidation is thus advanced inward. In $TiO_2$, Ti has a tetravalent positive charge and O has a divalent negative charge. Accordingly, if the element of the group V (P, As or Sb) having a pentavalent positive charge and/or the element of the group VI (Se or Te) having a hexavalent positive charge is present in $TiO_2$, the concentration of the oxygen vacancy is reduced to maintain the charge balance in the interior, the paths of diffusion of external oxygen atoms through $TiO_2$ are reduced, and the oxidation is suppressed. The effect of suppressing the oxidation by the element of the group V and/or the element of the group VI is enhanced with an increase of the content of the additive element. If the content of the additive element is lower than 10 atomic ppm, the oxidation-suppressing effect is not satisfactory. If the content of the additive element exceeds 3000 atomic ppm, the content exceeds the dissolution limit in $TiO_2$ and the additive element is concentrated at the interface between the $TiO_2$ oxidation scale and the TiAl matrix to form a compound such as TiP, TiAs, TiSb, TiSe, $TiSe_2$ or $TiTe_2$ at the interface, with the result that a breakaway of the oxidation layer occurs there and the oxidation rate is greatly increased. For the above-mentioned reasons, in the present invention, the content of the element of the group V (P, As or Sb) and/or the element of the group VI (Se or Te) in the Ti—Al intermetallic compound is adjusted to 10 to 3000 atomic ppm.

Note, if the content of the additive element is up to 1000 atomic ppm, the effect whereby oxidation is effectively suppressed at temperatures of up to 800° C. can be obtained.

Bi has an effect of improving the oxidation resistance, but Bi increases the specific gravity and reduces the specific strength, and therefore, the material is disadvantageous as a high-temperature light-weight construction material. Accordingly, Bi is excluded from the element of the group V. The reason why S is excluded from the element of the group VI is that the bonding between Ti and S is too strong and causes premature breakaway of the $TiO_2$ oxidation scale. Po is excluded for the same reason as described above with respect to Bi.

If 0.01 to 3 atomic % of Mn and 0.01 to 1 atomic % of Si are incorporated in the Ti—Al intermetallic compound in combination with the element of the group V (P, As or Sb) and/or the element of the group VI (Se or Te), the room-temperature ductility and the high-temperature oxidation resistance can be further improved.

According to the process for the preparation of the Ti—Al intermetallic compound of the present invention, a mixture formed by adding 10 to 3000 atomic ppm of at least one element selected from the group consisting of P, As, Sb, Se and Te, optionally together with and Si, to 40 to 52 atomic % of Ti and 48 to 60 atomic % of Al is once placed under vacuum (under a pressure lower than 10 Torr), and then the atmosphere is replaced by Ar gas and the mixture is made molten at a temperature higher than the melting point and ranging from 1400° to 1500° C., to minimize a reaction with a crucible, and then the melt is solidified. A room-temperature ductility can be obtained in the as-solidified state, but if the solidification product is annealed in the above-mentioned inert gas atmosphere, to obtain a uniform microstructure, the ductility is further improved.

The so-obtained Ti—Al intermetallic compound having the element of the group V (P, As or Sb) and/or the element of the group VI (Se or Te) incorporated therein has a compressibility of at least 25% at room temperature and a compressibility of about 60% at 600° C., and the ductility is improved at temperatures ranging from room temperature to about 800° C. Since the tertiary element-free Ti—Al intermetallic compound has a compressibility of 0.4% at room-temperature and a compressibility of 1.1% at 700° C. (see Japanese Unexamined Patent Publication No. 58-123847), it is obvious that the performance is greatly improved according to the present invention. Moreover, the high-temperature oxidation resistance is greatly improved compared with that of the tertiary element-free Ti—Al intermetallic compound and the Mn-added Ti—Al intermetallic compound.

The reasons why the room-temperature compressibility and the high-temperature oxidation resistance are improved by incorporation of at least one element selected from the group consisting of P, As, Sb, Se and Te in the Ti—Al intermetallic compound will now be described.

It is considered that the improvement of the room-temperature compressibility is caused by a reduction of the stacking fault energy of the Ti—Al intermetallic compound by the addition of the tertiary element such as the element of the group V (P, As or Sb) or the element of the group VI (Se or Te). This reduction of the stacking fault energy facilitates twinning, especially crossing of twins, resulting in improved ductility. By electron microscope observation or in-situ high voltage electron microscope observation, it has been confirmed that, in the tertiary element-free Ti—Al intermetallic compound, twinning does not occur, but in the tertiary element-incorporated Ti—Al intermetallic compound, twinning easily occurs and the plastic deformation is advanced. By electron microscope observations, it was confirmed that this crossing of twins does not produce dislocation pile ups at the twin boundary during plastic deformation, and instead mobile dislocations are formed by a dislocation reaction to increase the ductility.

The high-temperature oxidation resistance is improved by preventing a permeation of oxygen by forming an oxide film on the surface of a material. In the case of the Ti—Al intermetallic compound, it is considered that oxidation is advanced by a diffusion of oxygen through oxygen ion-vacancies in $TiO_{2-x}$ formed on the surface of the sample, and accordingly, in order to improve the high-temperature oxidation resistance, the concentration of the oxygen ion-vacancies must be reduced and the rate of the inward diffusion of oxygen must be suppressed.

The reason why the high-temperature oxidation resistance is improved in the alloy of the present invention is considered to be because the element of the group V (P, As or Sb) or the element of the group VI (Se or Te) has a valence electron number of 5 or 6 $TiO_{2-x}$ layer formed on the surface and suppresses the respectively, larger than the valence electron number of Ti, i.e., 4, and therefore the tertiary element the oxide layer $TiO_{2-x}$ formed on the Ti—Al intermetallic reduces the concentration of oxygen ion-vacancies in the inward diffusion of oxygen, whereby the growth rate of compound in a high-temperature oxidizing atmosphere is reduced.

The present invention will now be described in detail with reference to the following examples, that by no means limit the scope of the invention.

EXAMPLE 1

A mixture comprising 50 atomic % of pure sponge titanium and 50 atomic % of Al, in which 94 atomic ppm (100 weight ppm) of Se or 58 atomic ppm (100 weight ppm) of Te was incorporated, was once placed under vacuum (pressure lower than $10^{-6}$ Torr) in a vacuum melting furnace, the atmosphere was replaced by Ar gas, and the mixture was heated at 1500° C. made molten, and then solidified. The solidified product was then annealed at 1000° C. and a heating time of 72 hours. The results are shown in Tables 1 and 2.

As apparent from the results shown in Tables 1 and 2, the samples of the present invention had a greatly improved yield stress under compression deformation and the room-temperature compressibility was greatly improved compared with that of the tertiary element-free Ti—Al intermetallic compound. Furthermore, the yield stress and room-temperature compressibility of the samples of the present invention were comparable to those of the Ti—Al intermetallic compound having 2% by weight of Mn added thereto. With respect to the oxidation resistance, the amount increased by oxidation in the Mn-added Ti—Al intermetallic compound was much larger than in the tertiary element-free Ti—Al intermetallic compound, but in the Se- or Te-added Ti—Al intermetallic compound, the amount increased by oxidation was much smaller, and it was confirmed that the oxidation resistance was remarkably improved.

TABLE 1

| Sample | | Composition | Experiment Temperature | Yield Stress (kg/mm²) | Compressibility (%) |
|---|---|---|---|---|---|
| Present invention | Te-added TiAl | Ti 63.9 wt % (50 at %)<br>Al 36.0 wt % (50 at %)<br>Te 100 wt ppm (58 at ppm) | room temperature | 41.5 | 28.0 |
| | Se-added TiAl | Ti 63.9 wt % (50 at %)<br>Al 36.0 wt % (50 at %)<br>Se 100 wt ppm (94 at ppm) | room temperature | 36.5 | 28.0 |
| Comparison | TiAl | Ti 48 at %<br>Al 52 at % | room temperature | 32.6 | 0.4 |

TABLE 2

| Sample | | Composition | Experiment Temperature | Yield Stress (kg/mm²) | Compressibility (%) |
|---|---|---|---|---|---|
| Present invention | Te-added TiAl | Ti 63.9 wt % (50 at %)<br>Al 36.0 wt % (50 at %)<br>Te 100 wt ppm | 600° C. | 45.5 | 40.0 |
| | | | 800° C. | 41.5 | 55.0 |

TABLE 2-continued

| Sample | | | Composition | Experiment Temperature | Yield Stress (kg/mm$^2$) | Compressibility (%) |
|---|---|---|---|---|---|---|
| | | | (58 at ppm) | | | |
| | Se-added TiAl | Ti | 63.9 wt % (50 at %) | 600° C. | 41.0 | 42.5 |
| | | Al | 36.0 wt % (50 at %) | 800° C. | 35.0 | 57.5 |
| | | Se | 100 wt ppm (94 at ppm) | | | |
| Comparison | TiAl | Ti | 48 at % | 700° C. | 31.5 | 1.1 |
| | | Al | 52 at % | | | |

EXAMPLE 2

A mixture comprising 50 atomic % (63.9% by weight) of sponge Ti having a purity of 99.8% by weight and 50 atomic % (36.0% by weight) of Al having a purity of 99.99% by weight, in which 500 weight ppm of P was incorporated, was once placed under vacuum (pressure lower than $10^{-6}$ Torr) in a vacuum melting furnace, the atmosphere was replaced by Ar gas, and the mixture was heated at 1500° C., made molten, and then solidified. A part of the solidified product was then annealed at 1000° C. for 72 hours.

Figure 2:
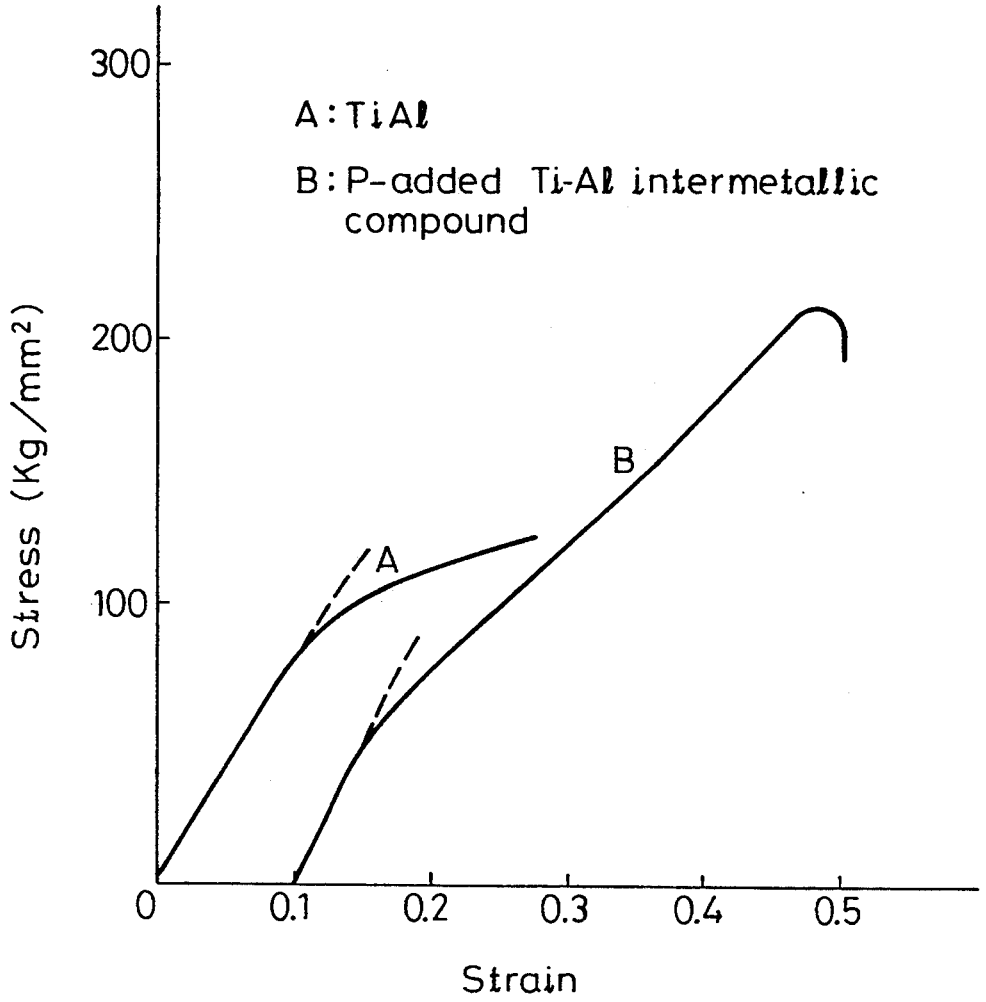

A test piece having a diameter of 5 mm and a height of 5 mm was cut from the obtained sample, and the room-temperature compressibility test was carried out. The results are shown in the stress-strain curve of FIG. 2. From FIG. 2, it is seen that, in the P-added Ti—Al sample, the room-temperature ductility was greatly improved compared to the P-free Ti—Al sample.

The data of the yield stress and ductility of the P-free and P-added Ti—Al samples at the room-temperature compression and the data of the yield stress and ductility of the P-added and P-free Ti—Al samples upon compression at 800° C. are shown in Tables 3 and 4, respectively.

TABLE 3

| Sample | | | Composition | Annealing | Yield Stress (kg/mm$^2$) | Compressibility (%) |
|---|---|---|---|---|---|---|
| Present invention | P-added TiAl | Ti | 63.9 wt % (50 at %) | 1000° C. | 46.9 | 31.4 |
| | | Al | 36.0 wt % (50 at %) | 72 hours | | |
| | | P | 500 wt ppm (1200 at ppm) | not effected (as-cast) | 51.0 | 20.0 |
| Comparison | TiAl | Ti | 48 atomic % | 1000° C. | 32.6 | 0.4 |
| | | Al | 52 atomic % | 72 hours | | |

TABLE 4

| Sample | | | Composition | Annealing | Experiment Temperature | Yield Stress (kg/mm$^2$) | Compressibility (%) |
|---|---|---|---|---|---|---|---|
| Present invention | P-added TiAl | Ti | 63.9 wt % (50 at %) | 1000° × 72 hr | 600° C. | 52.4 | 40.0 |
| | | Al | 36.0 wt % (50 at %) | | 800° C. | 40.9 | >65 |
| | | P | 500 wt ppm (1200 at ppm) | | | | |
| Comparison | TiAl | Ti | 48 at % | 1000° × 72 hr | 700° C. | 31.5 | 1.1 |
| | | Al | 52 at % | | | | |

EXAMPLE 3

Materials comprising Ti and Al in amounts shown in Table 5, in which the element of the group V, the element of the group VI, Si and Mn were incorporated as shown in Table 5, were treated in the same manner as described in Example 1. The results are shown in Table 5.

From the results shown in Table 5, it is seen that a Ti—Al intermetallic compound having an improved room-temperature ductility and retaining a good high-temperature oxidation resistance can be obtained according to the process of the present invention.

TABLE 5

| | Run No. | Ti | Al | Mn | Si | P | As | Sb | Se | Te | Room-Temperature Compressibility (%) | High-Temperature Oxidation Resistance (amount increased by oxidation at 800° C. for 100 hours, g/m$^2$) |
|---|---|---|---|---|---|---|---|---|---|---|---|---|
| Present invention | 1 | 50 | 50 | | | 0.01 | | | | | 33.9 | 6.0 |
| | 2 | 49.9 | 49.9 | | | 0.10 | | | | | 33.1 | 10.8 |
| | 3 | 49.9 | 49.9 | | | 0.12 | | | | | 31.4 | 12.0 |
| | 4 | 49.9 | 49.9 | | | 0.30 | | | | | 31.0 | 14.0 |
| | 5 | 50 | 50 | | | | 0.01 | | | | 36.0 | 14.2 |
| | 6 | 49.9 | 49.9 | | | | 0.10 | | | | 27.5 | 14.2 |

TABLE 5-continued

| | Run No. | Ti | Al | Mn | Si | P | As | Sb | Se | Te | Room-Temperature Compressibility (%) | High-Temperature Oxidation Resistance (amount increased by oxidation at 800° C. for 100 hours, g/m$^2$) |
|---|---|---|---|---|---|---|---|---|---|---|---|---|
| | 7 | 49.9 | 49.9 | | | | 0.30 | | | | 28.1 | 14.3 |
| | 8 | 50 | 50 | | | | | 0.01 | | | 28.5 | 14.1 |
| | 9 | 49.9 | 49.9 | | | | | 0.10 | | | 28.3 | 14.2 |
| | 10 | 49.9 | 49.9 | | | | | 0.30 | | | 28.2 | 14.2 |
| | 11 | 50 | 50 | | | | | | 0.01 | | 28.0 | 2.9 |
| | 12 | 49.9 | 49.9 | | | | | | 0.10 | | 34.4 | 5.0 |
| | 13 | 49.9 | 49.9 | | | | | | 0.30 | | 32.5 | 7.8 |
| | 14 | 50 | 50 | | | | | | | 0.01 | 28.0 | 3.6 |
| | 15 | 49.9 | 49.9 | | | | | | | 0.10 | 32.5 | 6.5 |
| | 16 | 49.9 | 49.9 | | | | | | | 0.30 | 30.0 | 8.5 |
| | 17 | 51 | 49 | | | 0.01 | | | | | 28.1 | 7.0 |
| | 18 | 45 | 55 | | | 0.01 | | | | | 31.5 | 6.5 |
| | 19 | 40 | 60 | | | 0.01 | | | | | 29.8 | 6.4 |
| | 20 | 51 | 49 | | | 0.01 | | | | 0.01 | 30.3 | 16.5 |
| | 21 | 50.9 | 48.9 | | | 0.10 | | | | 0.10 | 29.3 | 11.5 |
| | 22 | 50 | 50 | | | 0.01 | | | | 0.01 | 29.4 | 6.7 |
| | 23 | 49.9 | 49.9 | | | 0.10 | | | | 0.10 | 28.3 | 12.2 |
| | 24 | 49 | 51 | | | 0.01 | | | | 0.01 | 29.1 | 6.8 |
| | 25 | 49.9 | 50.9 | | | 0.10 | | | | 0.10 | 27.9 | 14.2 |
| | 26 | 48 | 52 | | | 0.01 | | | | 0.01 | 26.7 | 6.8 |
| | 27 | 47.9 | 51.9 | | | 0.10 | | | | 0.10 | 25.6 | 14.2 |
| | 28 | 50 | 50 | | | 0.01 | 0.01 | | | 0.01 | 30.5 | 6.5 |
| | 29 | 49.4 | 48.7 | 1.03 | 0.87 | 0.01 | | | | | 31.0 | 6.0 |
| Comparison | 30 | 49.5 | 48.8 | 1.03 | 0.87 | | | | | | 24.0 | 14.0 |
| | 31 | 50 | 48.8 | 1.4 | | | | | | | 26.0 | 55.0 |
| | 32 | 48 | 52 | | | | | | | | 0.4 | 14.5 |

I claim:

1. An annealed, solidified Ti—Al intermetallic compound having a uniform microstructure and compressibility of at least 25% at room temperature formed by annealing of the solidified compound, and further having a superior high temperature oxidation resistance, said annealed, solidified compound consisting essentially of about 40 to 52 atomic % of Ti and about 48 to 60 atomic % of Al and contains 10 to 1000 atomic ppm of Se.

2. A Ti—Al intermetallic compound as set forth in claim 1, which comprises 40 to 50 atomic % of Ti and 50 to 60 atomic % of Al and contains 100 to 1000 atomic ppm of P.

3. A Ti—Al intermetallic compounds as set forth in claim 1, which comprises 45 to 50 atomic % of Ti and 50 to 55 atomic % of Al and contains 100 to 1000 atomic ppm of P.

4. A Ti—Al intermetallic compound as set forth in claim 1, which further contains 0.01 to 3 atomic % of Mn and 0.01 to 1 atomic % of Si.

5. An annealed, solidified Ti—Al intermetallic compound having a uniform microstructure and compressibility of at least 25% at room temperature formed annealing of the solidified compound, and further having a superior high temperature oxidation resistance, said annealed, solidified compound consisting essentially of about 40 to 52 atomic % of Ti and about 48 to 60 atomic % of Al and contains 10 to 1000 atomic ppm of Se and having a compressibility of about 60% at 600° C.

* * * * *

UNITED STATES PATENT AND TRADEMARK OFFICE

CERTIFICATE OF CORRECTION

PATENT NO. : 5,348,594 
DATED : September 20, 1994
INVENTOR(S) : Toshihiro HANAMURA, et al.

It is certified that error appears in the above-indentified patent and that said Letters Patent is hereby corrected as shown below:

Column 3, line 31, change "v" to --V--.

Column 4, line 46, after "with" insert --Mn--.

Column 4, line 49, change "10" to --$10^{-6}$--.

Column 5, line 3, after "6", delete everything else to end of paragraph and insert the following: --respectively, larger than the valence electron number of Ti, i.e., 4, and therefore the tertiary element reduces the concentration of oxygen ion-vacancies in the $TiO_{2-x}$ layer formed on the surface and suppresses the inward diffusion of oxygen, whereby the growth rate of the oxide layer $TiO_{2-x}$ formed on the Ti-Al intermetallic compound in a high-temperature oxidizing atmosphere is reduced.--

UNITED STATES PATENT AND TRADEMARK OFFICE

CERTIFICATE OF CORRECTION

PATENT NO. : 5,348,594

DATED : September 20, 1994

INVENTOR(S) : Toshihiro HANAMURA, et al.

It is certified that error appears in the above-indentified patent and that said Letters Patent is hereby corrected as shown below:

Column 10, line 38, after "and" insert --a--.

Column 10, line 39, after "formed" insert --by--.

Signed and Sealed this

Twenty-first Day of February, 1995

*Attest:*

Bruce Lehman

BRUCE LEHMAN

*Attesting Officer*

*Commissioner of Patents and Trademarks*